United States Patent [19]

Hisatake et al.

[11] Patent Number: 5,029,540

[45] Date of Patent: Jul. 9, 1991

[54] AUTOMATIC EMBROIDERING MACHINE

[75] Inventors: Michio Hisatake; Takeshi Kongo; Hidenori Sasako, all of Tokyo, Japan

[73] Assignee: Janome Sewing Machine Co., Ltd., Tokyo, Japan

[21] Appl. No.: 390,181

[22] Filed: Aug. 4, 1989

[30] Foreign Application Priority Data

Aug. 5, 1988 [JP] Japan ..... 63-194380

[51] Int. Cl.[5] ..... D05B 21/00; D05C 5/06

[52] U.S. Cl. ..... 112/121.12; 112/103; 112/262.3; 112/266.1

[58] Field of Search ..... 112/103, 121.12, 163, 112/155, 98, 221, 121.11, 102, 266.1, 262.3

[56] References Cited

U.S. PATENT DOCUMENTS 4,453,477 6/1984 Gerber ..... 112/121.12

4,526,116 7/1985 Mannel ..... 112/103 X 4,531,467 7/1985 Golia, Jr. et al. ..... 112/163 X

*Primary Examiner*—Peter Nerbun

*Attorney, Agent, or Firm*—Michael J. Striker

[57] ABSTRACT

An automatic embroidering machine comprising a stitch forming unit including a vertically reciprocating needle, an embroidering frame for supporting a fabric to be stitched, a drive for effecting X-Y movement of the embroidering frame in accordance with vertical reciprocal movement of the needle, a first control unit for coordinating codes for embroidering patterns of the same color in sequence by comparing color changing codes included in embroidering data, and a second control unit for moving the embroidering frame to a coordinate with a color changing code of a different color to form patterns of different colors.

6 Claims, 12 Drawing Sheets

FIG_1(B)

1.Process of changing embroidering colors

2.Finish 10.32.Key-point

11.An embroidering start key ?

12.34.Handling of other keys

13.Read in the data from RAM 14.23.A color changing code ?

15.Store the color changing code and the coordinate of the color changing position in RAM 16.A first color ?

17.Store the coordinate of the color changing position in RAM

18.Is the data finished ?

FIG_1(B)(cont'd)

29. Obtain the starting position coordinate of the subsequent color, referring to the data stored in (17)
30. Move the embroidering frame to the position obtained in (29)
31. Indicate in (DISP) changing of colors of the embroidering thread
33. The embroidering start key ?
35. Have all the embroidering patterns been stitched ?
36. The embroidering process
40. Calculate needle dropping points, and move the embroidering frame

FIG_1(C)

19. Control code ?
20. Renew coordinate values of the embroidering frame
21. Store the initial color changing code as the present embroidering colors
22. Read in the data from RAM
24. Compare with the code of the present embroidering color
25. Same color ?
26. Obtain the starting position coordinate of the subsequent patterns of the same color, referring to the data stored in (15)
27. Is there a subsequent pattern in (26) ?
28. Register the color code of the subsequent patterns as the present color

FIG_1(D)

29. Obtain the starting position coordinate of the subsequent color, referring to the data stored in (17)
30. Move the embroidering frame to the position obtained in (29)
31. Indicate in (DISP) changing of colors of the embroidering thread
33. The embroidering start key ?
35. Have all the embroidering patterns been stitched ?
36. The embroidering process
40. Calculate needle dropping points, and move the embroidering frame FIG_4
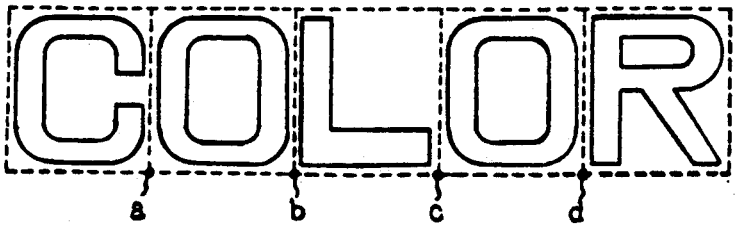
FIG_5
| | | | | | | | | | |
|---|---|---|---|---|---|---|---|---|---|
| C 1 | "C" data | C 2 | "O" data | C 3 | "L" data | C 2 | "O" data | C 1 | "R" data |
FIG_6
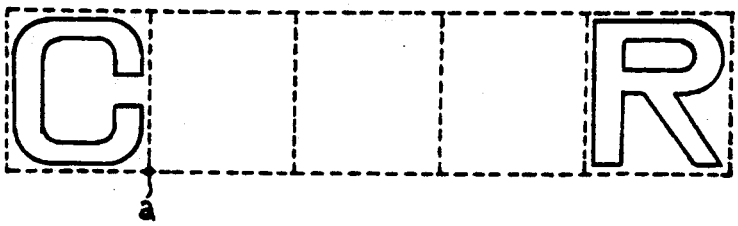
FIG_7
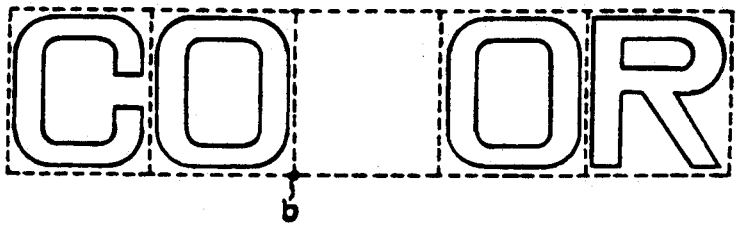

FIG_12
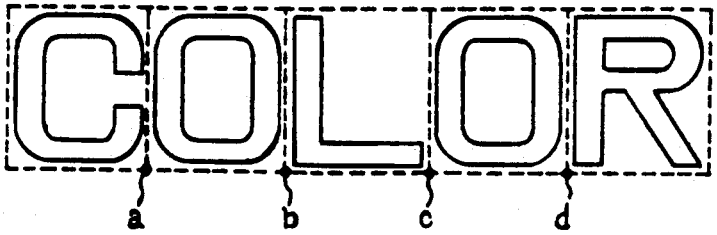
FIG_13
| | | | | | | | | | |
|---|---|---|---|---|---|---|---|---|---|
| C 1 | "C" data | C 2 | "O" data | C 3 | "L" data | C 2 | "O" data | C 1 | "R" data |
FIG_14
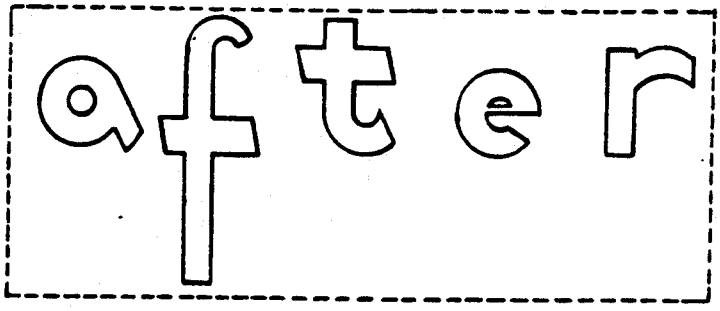
FIG_15
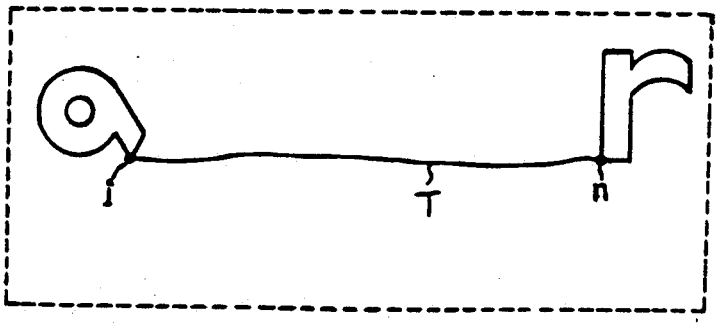

AUTOMATIC EMBROIDERING MACHINE

FIELD OF THE INVENTION

The present invention relates to an automatic embroidering machine which produces efficiently beautiful multi-color embroiderings of a plurality of patterns.

BACKGROUND OF THE INVENTION

The invention relates to automatic embroidering machines for producing multi-color embroiderings. Prior art discloses automatic machines for multi-color embroidering.

With respect to forming sequences of embroidered patterns with changing colors with conventional automatic embroidering machines, an explanation will be made referring to with FIGS. 12 and 13.

If patterns shown in FIG. 12 are to be formed, and those data are arranged as shown in FIG. 13, the patterns are formed in following sequences, where C1 to C3 are color changing codes.

A letter C is stitched with a thread of Color C1.

As an embroidering machine stops to change this color at a point "a", the thread is changed to a thread of Color C2.

The next letter O is stitched with the thread of Color C2.

As the machine stops to change this color at a point "b", the thread is changed to a thread of Color C3, and the letter L is formed with the thread of Color C3.

As the machine stops to change this color at a point "c", the thread is changed to Color C2 and the second letter O is formed with the thread of Color C2.

As the machine stops to change this color at a point "d", the thread is changed to Color C1, and the letter of R is stitched with the thread of Color C1.

As it is seen apparently, the machine stops each time to change colors of the embroidering threads. For example, if the colors of the threads are very often changed as C1, C2, C3, C1, C2, C1, C3, C1, C2, C3, C2 . . . , the machine stops at such a time for changing the threads. Therefore, the operation consumes much time inefficiently.

SUMMARY OF THE INVENTION

It is an object of the invention to provide an automatic multi-color embroidering machine which consumes less time in forming a multi-color embroidering pattern than a conventional embroidering machine forming a similar pattern. The object of the invention is achieved with an embroidering machine comprising first control means which, in embroidering data, includes color changing codes and coordinate codes for embroidering patterns of the same colors in sequence by comparing the color changing codes, and a second control means for moving an embroidering frame to a coordinate which shows a color changing code of a different color so as to form patterns of the different colors.

The automatic embroidering machine according to the invention further comprises calculation means, in the first control means, which calculates needle dropping points for moving the embroidering frame such that bridging threads between the formed patterns of the same colors having been skipped by the first control means, are not involved by a subsequent embroidering pattern of the other color.

According to the invention, since it is possible to reduce changing of the embroidering thread to the minimum even when forming embroidering multi-color patterns, the embroidering may be performed efficiently, and in addition since the bridging thread is not involved by the following pattern of the different color, beautiful embroidered patterns may be formed.

The present invention both as to its construction so to its mode of operation, together with additional objects and advantages thereof, will be best understood from the following description of the preferred embodiments with reference to the accompanying drawings.

BRIEF DESCRIPTION OF THE DRAWINGS

FIGS. 1B–1D is an explanation of steps shown in FIG. 1A.

FIG. 4 shows an example of an embroidered pattern;

FIG. 5 shows embroidering data of the patterns of FIG. 4;

FIGS. 6 and 7 show embroidering sequences;

FIG. 12 shows an example of a conventional embroidering pattern identical to that of FIG. 4;

FIG. 13 shows embroidering data of the pattern of FIG. 12;

FIG. 14 shows an example of another embroidered pattern;

FIG. 15 shows a condition of a bridging thread when forming embroidered patterns;

DETAILED DESCRIPTION OF PREFERRED EMBODIMENTS

Figure 3:
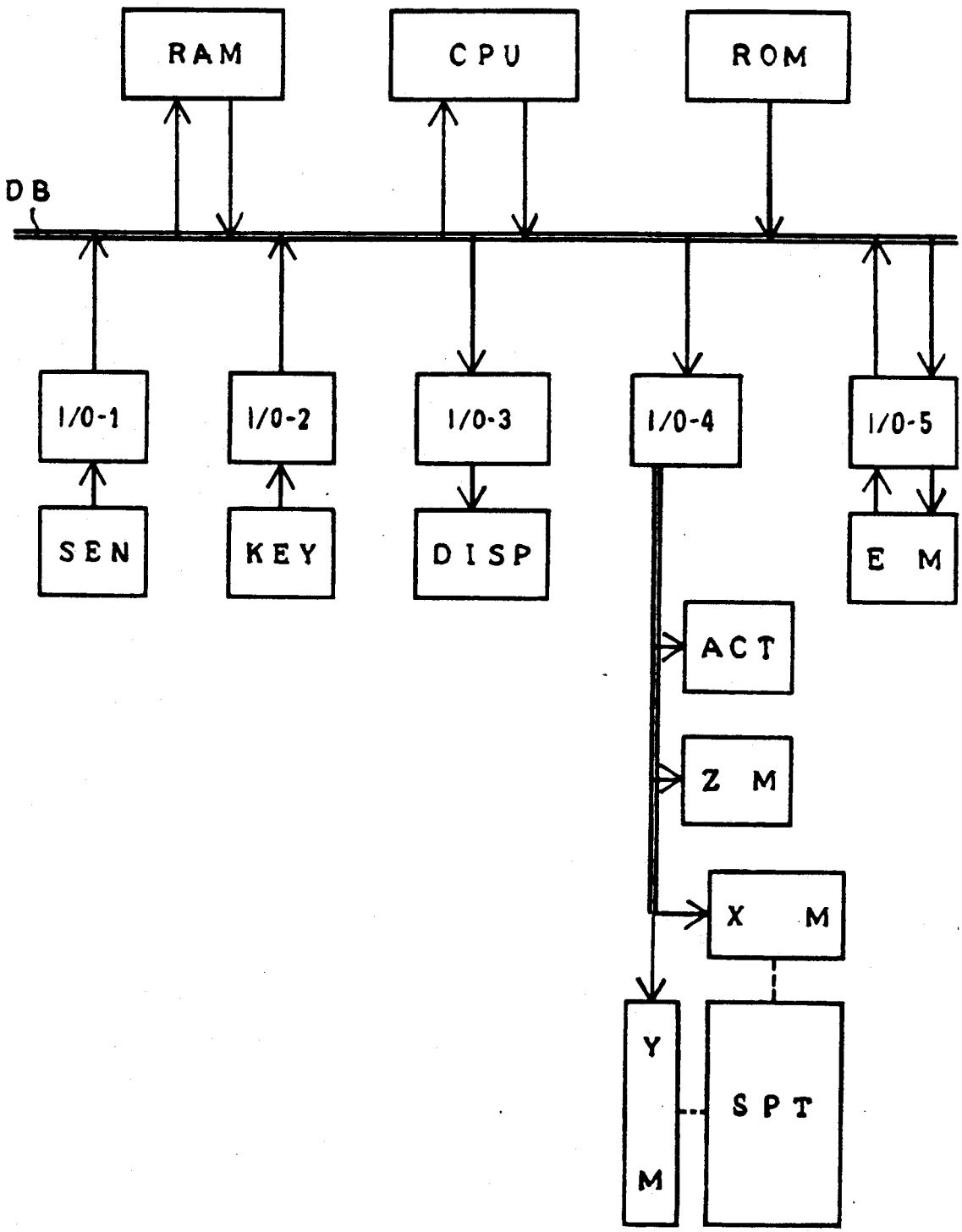
FIG. 3 is a block diagram of an automatic embroidering machine.

An automatic embroidering machine will be described with a reference to the block-diagram of FIG. 3.

A central processing unit (CPU) is connected with a read only memory (ROM) for storing a control program via a data base line (DB) and a random access memory (RAM) for storing embroidering data temporally.

The data base line (DB) is connected, via an input-output device (I/O-1), with a sensor (SEN) for obtaining various control parameters such as phases of a needle bar so as to control the embroidering machine. An input-output device (I/O-2), with operation keys (KEY) serves for receiving orders such as selections of embroidering patterns from a machine operator. An input-output device (I/O-3) has an indicator (DISP) for indicating operations of an operating key such as the selected embroidering patterns. An input-output device (I/O-4), with pulse motors (XM)(YM) carries out X-Y controls of the supporter (SPT) connecting with an embroidering frame 10 movable relative to the needle 12. A machine motor (ZN) drives stitch forming means and an actuator (ACT) such as a solenoid for slacking a thread, to form the patterns. An input-output device (I/O-5), with an external memory (EM) is used for storing a plurality of embroidering data.

The embroidering process with changing the colors will be discussed mainly with reference to the flow chart of FIG. 1. Reference numerals in the following explanation will show respective steps of the control sequence.

Steps (10) to (20) are used for carrying out searches of color changing commands, and Step (21) and following steps are used for controlling the embroidering operation. The performed steps are as follows:

(10): waits for an input from the key (KEY), and goes to a next step on the input therefrom, (11): goes to (13) if it is an embroidering start key, (12): carries out other commands than the embroidering start, and goes back to (10), (13): reads in the data from the memory (RAM), (14): checks the data obtained at (13), and goes to (18) if the checked data is not a color changing code, (15): stores in (RAM) the color changing code among the data obtained at (13) and the position coordinate of the embroidering frame, (16): checks whether the color changing code obtained at (13) has firstly appeared, and if not, goes back to (13) for checking a next data, (17): if yes as a result of checking (16), stores the position coordinate of the frame in (RAM), and goes back to (13), (18): checks whether the data obtained at (13) is a final code, and if yes, goes to (21), (19): checks whether the data obtained at (13) is a control data, and if yes, goes back to (13), (20): obtains a new position coordinate from data obtained at (13) as a position coordinate of the present embroidering frame, stores it in (RAM) and goes back to (13), (21): re-sets a read-in pointer of the data, and stores in (RAM) the color changing code of the first embroidering pattern as the present embroidering color from the data stored in (17), (22): reads in the data from (RAM), (23): checks the data obtained at (22), and goes to (35) if it is not the color changing code, (24): if it is the color changing code, compares with the present embroidering color, (25): goes to (35), if the compared result at (24) is the same color, (26): if the compared result at (24) is a different color, obtain a position coordinate of the embroidering start of a next pattern of the same color as the present color with reference to the data stored at (15), (27): goes to (40), if a next embroidering pattern exists in the process at (26), (28): if the next pattern does not exist in a process of (26), registers the color code of a next pattern as a present pattern, with reference to the data stored at (17), (29): obtains the position coordinate of an initial embroidering pattern of a next color, (30): moves the embroidering frame to the position coordinate obtained at (29), (31): shows in the indicator (DISP) to change the color of the thread, (32): waits for an input from the key (KEY), and goes to a next step on the input therefrom, (33): if it is the embroidering start key, goes back to (22) to continue the embroidering, (34): carries out other processes than the embroidering start, and goes back to (32), (35): if the data obtained at (22) is not a final code, goes to a next step, and if it is the final code, finishes the embroidering of changing the color, (36): goes back to (22) after having embroidered, (40): carries out a calculation of the needle dropping and moves the embroidering frame until the position coordinate of the embroidering start obtained at (26).

With respect to Step (40) of the flow chart corresponding to this sub-routine, an explanation will be made to later in detail.

Figure 1A:
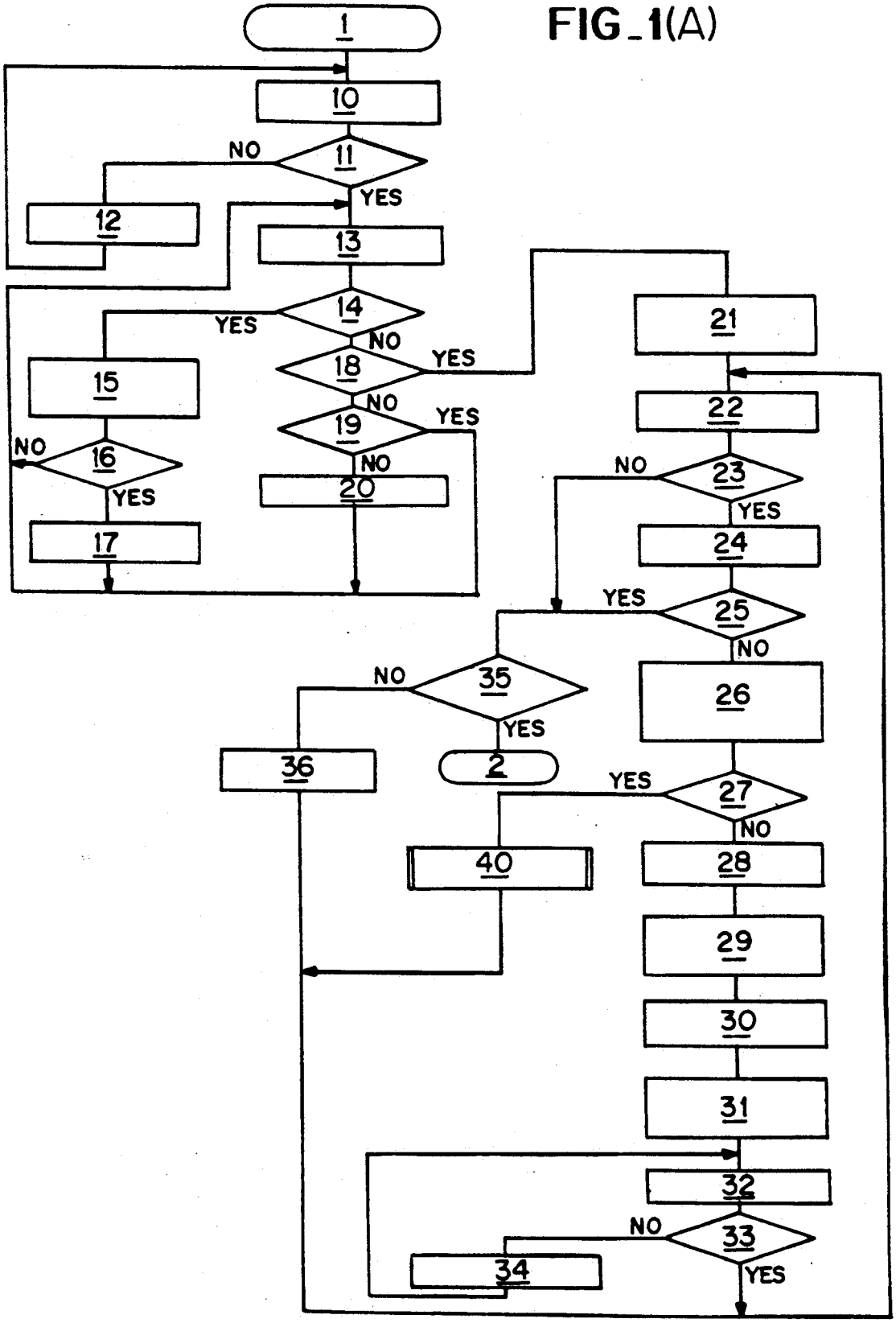
FIG. 1A is a flow chart showing embroidering processes for changing colors.

In the flow chart of FIG. 1, the main steps of the first control means where the patterns of the same colors are formed in sequence, are Steps (35), (36) and Steps (26), (27), (40). Steps (22) to (25) are common steps therebetween. Steps (26) to (30) are the main steps of the second control means which moves the embroidering frame to a coordinate where a color changing code of a different color appears for embroidering the patterns of the different colors. Step (40) is the main step of the calculation means which calculates the needle dropping points of the bridging thread and moves the frame.

With respect to the sequence of forming the patterns with changing the colors, an explanation will be made, referring to FIGS. 4 to 7.

If the embroidering pattern as shown in FIG. 4 and data as shown in FIG. 5, similar to those of FIGS. 12 and 13, the patterns are formed as follows, where C1 to C3 of FIG. 5 are the color changing codes.

(1): stitches the letter of C with the color of C1, (2): stitches the letter of R with the same color via Step (26), (27), (40) (FIG. 6), (3): changes to C2, since the stitching stops at the point "a" by Steps (26) to (30) of the second control means, (4): forms the letter of O with C2, (5): forms the letter of O with the same color via Steps (26), (27) and (40) of the first control means, (6): changes to C3, since the forming stops at the point "b" by Steps (26) to (30) of the second control means, (7): embroiders the letter of L with C3.

In forming of the patterns according to the invention, a consideration will be given to problems of the bridging thread between the produced patterns of the same color which have been skipped by the first control means.

If the letters of "a" and "r" have the same color, and the letters of "fte" have the different colors in FIGS. 14 and 15, the letters of "a" and "r" are firstly stitched in lump.

However, if no attention is paid to that the letters are of different colors, the embroidering thread is drawn as the bridging thread (T) as seen in FIG. 15 between a terminal point "i" of the stitched letter "a" and a start point "n" of the letter "r". If the letters "fte" are stitched with the other threads thereafter, the bridging thread (T) is involved, and it takes much time in removing the involved thread later.

Figure 10:
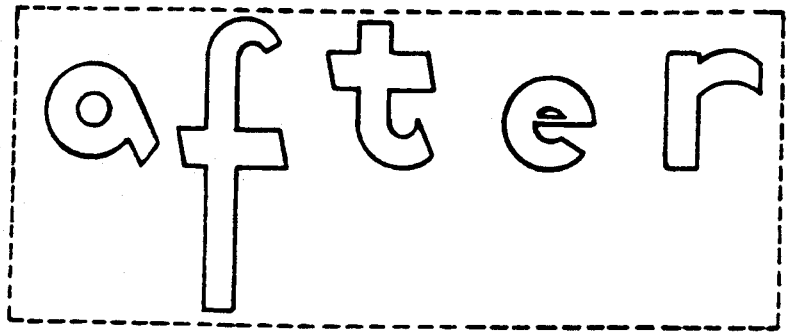
FIG. 10 shows an example of the embroidered pattern.

Such problems are solved by the invention as follows. If the letters of "a" and "r" of FIG. 10 have the same color as in FIG. 14 and the letters "fte" have the different color, the embroidering frame is moved such that the needle droppings pass the positions shown with points of i, j, k, l, m, n of FIG. 11 when the embroidering is carried out from the letters "a" to "r" by means of Step (40) of FIG. 1 which is the main step of the moving means.

Figure 2:
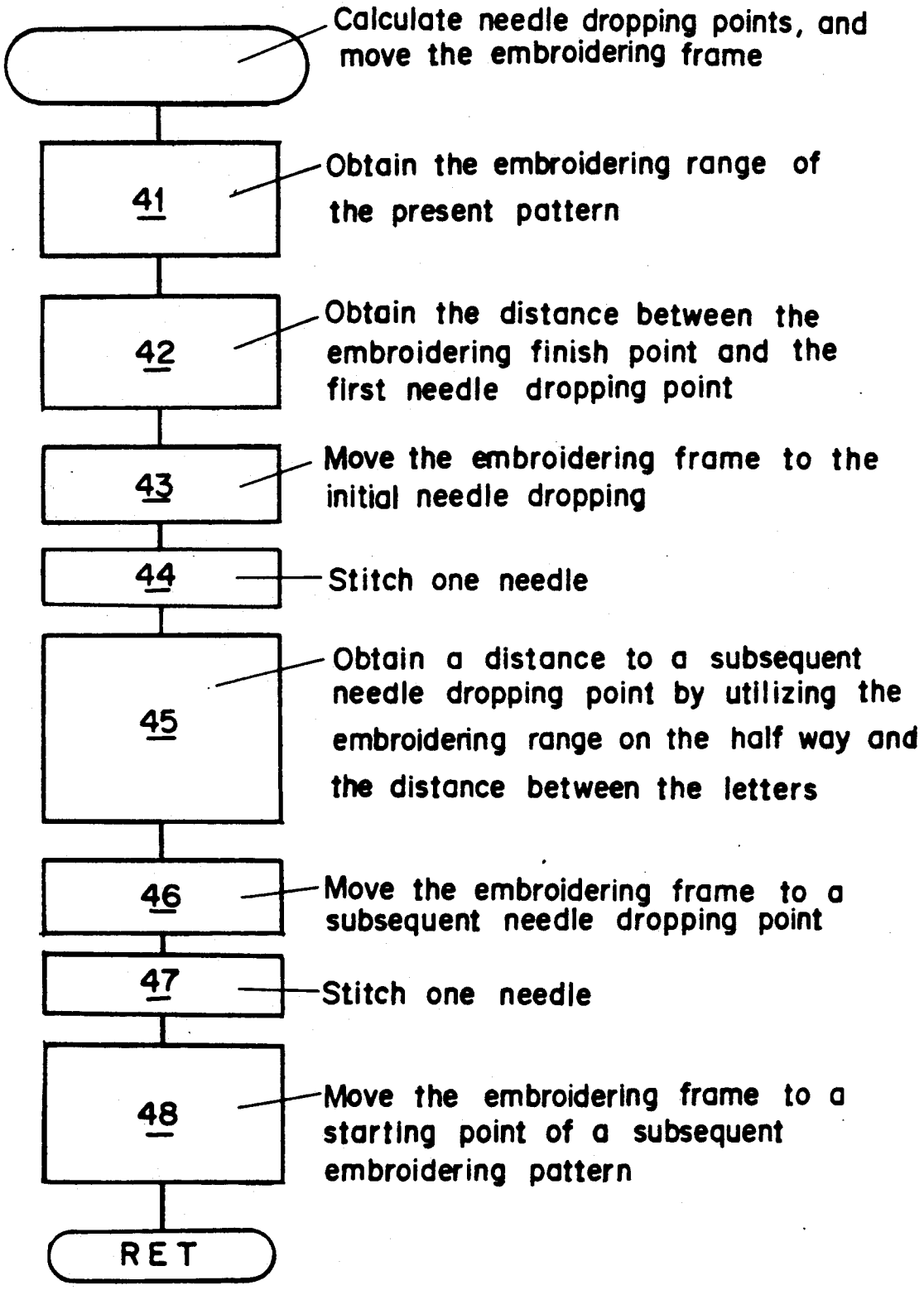
FIG. 2 is a flow chart showing a sub-routine in response to the step of calculating needle dropping points and moving an embroidering frame according to flow chart of FIG. 1.

The operation of the moving means will be explained with FIGS. 2, 8 and 9 wherein (41) to (48) of FIG. 2 show respective steps.

(41): obtains a moving distance until a first needle dropping point (point k of FIG. 11) which is a right upper point of the scope of finishing the embroidering pattern (letter "a"). In general, the embroidering scope is composed of elements shown in FIG. 8, and an actual scope is used by multiplying enlarging rate or reduction rate to this scope.

Figure 8:
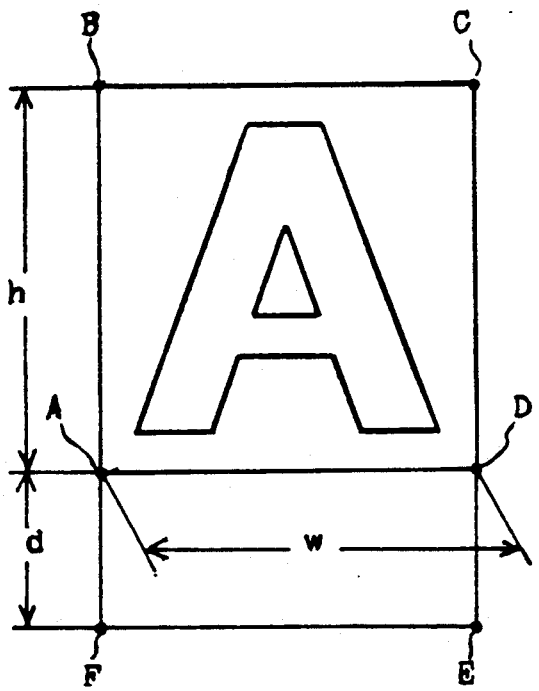
FIG. 8 shows elements of the embroidering data by figure or device.

In FIG. 8, h: height of the pattern, w: width of the pattern, u: height of a part protruded downward from A-D line.

The part "u" is normally zero, and is data prepared for letters such as "f" and "y" having downward protrusions beyond A-D line.

Figure 9:
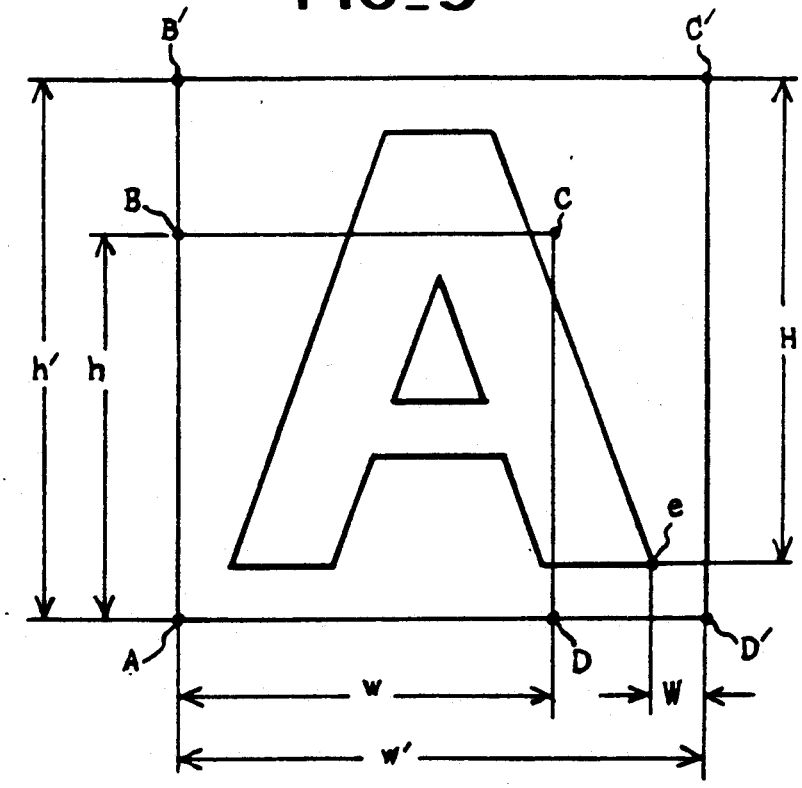
FIG. 9 shows modifications of FIG. 8 by figure or device.

If the actual embroidering scope is assumed as A-B'-C'-D' as shown in FIG. 9, an initial needle dropping point C' is w' (w'=width (w) of pattern x enlarging rate) in X-axis from a reference point A and h' (h'=height (h) of pattern x enlarging rate) in Y-axis from the same.

However, since the embroidering terminates at a point "e" as a result it is sufficient to obtain the distances H, W between e - C'.

H and W are respectively,

H=h'- ey

W=w'- ex.

"ex" and "ey" are coordinate positions from point A in x-axis and y-axis of point "e", which are obtained by multiplying the relative distance from the reference point A.

Figure 11:
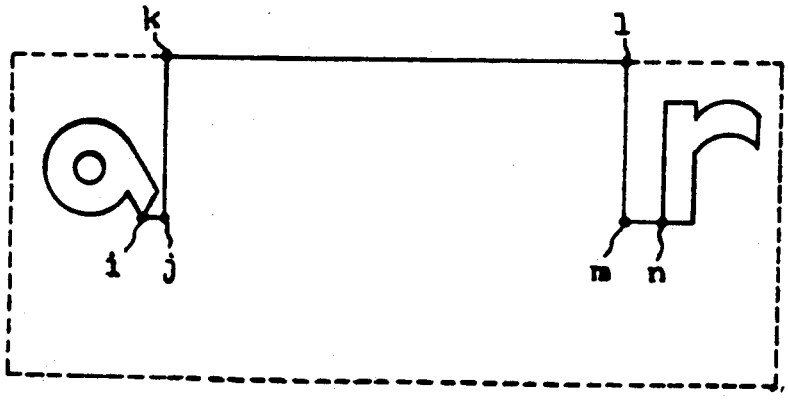
FIG. 11 shows relative positions between needle droppings and embroidered patterns.
Figure 16:
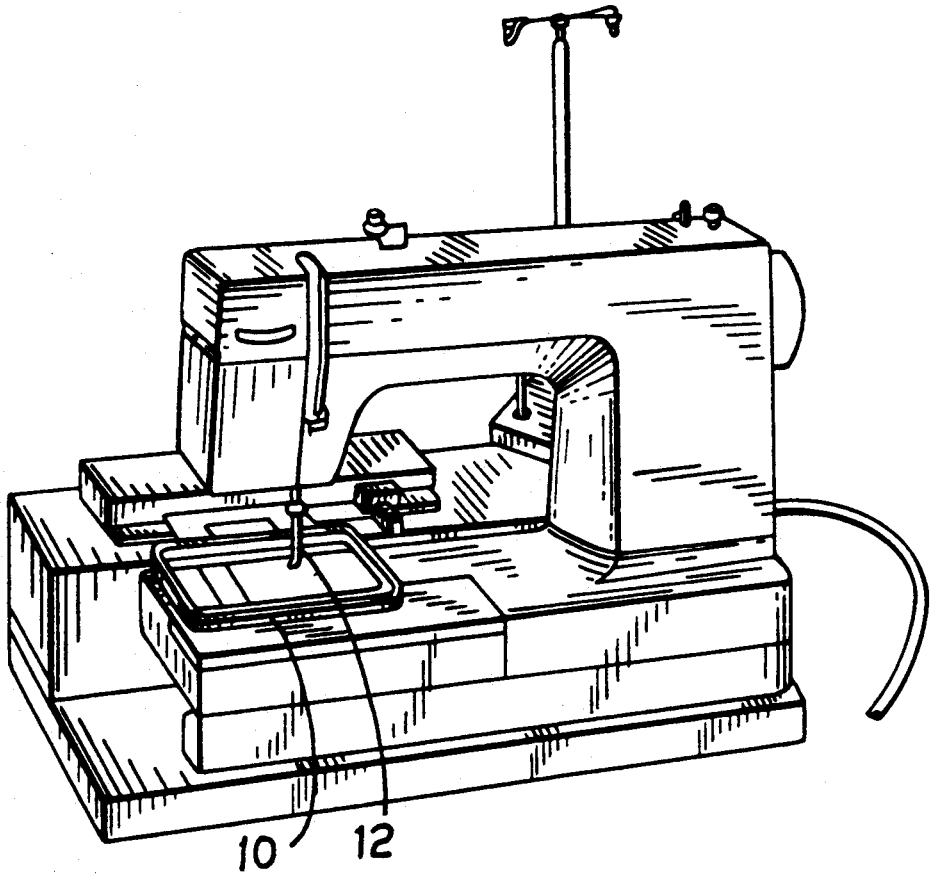
FIG. 16 shows a perspective view of an embroidering machine in which the control apparatus of the invention is used.

(42): obtains the distances H, W from points "i" to "k" of FIG. 11, (43): moves the frame by the amount of the distances H, W obtained at (42), that is, moves to point j on the x-axis by W and then moves to point k on the y-axis by H, (44): single-stitches at point k, (45): obtains a moving distance until a next needle dropping point ("l" of FIG. 11). This point is at a left upper point of the embroidering scope of a next embroidering pattern (letter "r"), and is actually obtained by width of letters "fte" x magnifying power + spaces between letters. Since the height on the Y-axis is not changed, the frame is not moved.

(46): moves the frame by the amount of the distance obtained at (45), (47): one-stitches at point "l" after moving, (48): finally moves the frame until point "n" of the embroidering start via point "m".

In the above thread bridging process, in FIG. 11, the needle dropping positions are obtained in order of the points j, k, l, m by moving the frame during moving from a stitch termination point "i" of letter "a" to a stitch starting point "n" of letter "r", and the stitchings are formed one-stitch by one-stitch at the points "k" and "l". Instead, it is also sufficient that the needle dropping points are obtained directly in order of the points "k" and "l", and the stitches are formed one-stitch by one-stitch at these points.

While the invention has been illustrated and described as embodied in an automatic embroidering machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An automatic embroidering machine comprising stitch forming means including a vertically reciprocating needle and needle thread catching means cooperating with said needle; an embroidering frame for supporting a fabric to be stitched; drive means for effecting X-Y movement of the embroidering frame in accordance with vertical reciprocal movement of the needle; first control means for coordinating codes for embroidering patterns of the same color in sequence by comparing color changing codes included in embroidering data; and second control means for moving the embroidering frame to a coordinate in response to a color changing code of a different color to form patterns of different colors.

2. An automatic embroidering machine as claimed in claim 1, wherein said first control means comprises calculation means for calculating needle dropping points for moving the embroidering frame in such a manner that a bridging thread between formed patterns of the same color having been skipped by the first control means is not present in a subsequent pattern of another color.

3. A control apparatus for an automatic embroidering machine including stitch forming means having a vertically reciprocating needle and needle thread catching means cooperating with said needle, an embroidering frame for supporting a fabric to be stitched and drive means for effecting X-Y movement of the embroidering frame in accordance with vertical reciprocal movement of the needle, said control apparatus comprising first control means for coordinating codes for embroidering patterns of the same color in sequence by comparing color changing codes included in embroidering data; and second control means for moving the embroidering frame to a coordinate in response to a color changing code of a different color to form patterns of different colors.

4. A control apparatus as claimed in claim 3, wherein said first control means comprises calculation means for calculating needle dropping points for moving the embroidering frame in such a manner that a bridging thread between formed patterns of the same color, having been skipped by said first control means, is not present in a subsequent pattern of another color.

5. A method of embroidering multi-color patterns comprising the steps of storing embroidering data including color changing codes; comparing color changing codes for different embroidering patterns; coordinating codes for embroidering patterns of the same color in sequence; and moving an embroidering frame to a coordinate in response to a color changing code of a different color to form patterns of different colors.

6. A method as claimed in claim 5, further comprising the step of calculating needle dropping points for moving the embroidering frame in such a manner that a bridging thread between formed patterns of the same color, having been skipped by the first control means, is not present in a subsequent pattern of another color.

* * * * *